US010887697B2

(12) United States Patent
Zhang

(10) Patent No.: US 10,887,697 B2
(45) Date of Patent: Jan. 5, 2021

(54) METHOD, SYSTEM AND APPARATUS FOR EXTRACTING TARGET UNWANTED AUDIO SIGNAL FROM MIXTURE OF AUDIO SIGNALS

(71) Applicant: Incus Company Limited, Hong Kong (CN)

(72) Inventor: Jiangang Zhang, Hong Kong (CN)

(73) Assignee: INCUS COMPANY LIMITED, Hong Kong (CN)

( * ) Notice: Subject to any disclaimer, the term of this patent is extended or adjusted under 35 U.S.C. 154(b) by 0 days.

(21) Appl. No.: 16/228,836

(22) Filed: Dec. 21, 2018

(65) Prior Publication Data

US 2019/0200135 A1 Jun. 27, 2019

(30) Foreign Application Priority Data

Dec. 21, 2017 (CN) ..... 2017 1 1395396
Dec. 21, 2017 (CN) ..... 2017 2 1809914 U

(51) Int. Cl.

| | |
|---|---|
| ***H04R 5/04*** | (2006.01) |
| ***H04R 5/027*** | (2006.01) |
| ***H04R 3/04*** | (2006.01) |
| ***G10L 21/0216*** | (2013.01) |
| ***G10L 21/0272*** | (2013.01) |
| ***G10L 21/0208*** | (2013.01) |

(52) U.S. Cl.

CPC ..... *H04R 5/04* (2013.01); *G10L 21/0208* (2013.01); *G10L 21/0216* (2013.01); *G10L 21/0272* (2013.01); *H04R 3/04* (2013.01); *H04R 5/027* (2013.01); *G10L 2021/02166* (2013.01); *H04R 2410/01* (2013.01); *H04R 2420/07* (2013.01)

(58) Field of Classification Search

CPC . H04R 5/04; H04R 3/04; H04R 5/027; H04R 2410/01; H04R 2420/07; G10L 21/0208; G10L 21/0216; G10L 21/0272; G10L 2021/02166

USPC ..... 381/94.1

See application file for complete search history.

(56) References Cited

U.S. PATENT DOCUMENTS

2015/0296294 A1* 10/2015 Paquier ..... G10L 21/0205 381/71.1

* cited by examiner

*Primary Examiner* — Vivian C Chin
*Assistant Examiner* — Douglas J Suthers
(74) *Attorney, Agent, or Firm* — Matthias Scholl P.C.; Matthias Scholl

(57) ABSTRACT

A method for removing a target unwanted signal from multiple signals. The method includes: providing a set of input signals from external devices; separating the input signals into channels with the unwanted signal and channels without the unwanted signal; synchronizing the sets of input signals; and transferring the separated signal via wire or wirelessly to a sound reproduction device.

8 Claims, 4 Drawing Sheets

METHOD, SYSTEM AND APPARATUS FOR EXTRACTING TARGET UNWANTED AUDIO SIGNAL FROM MIXTURE OF AUDIO SIGNALS

CROSS-REFERENCE TO RELATED APPLICATIONS

Pursuant to 35 U.S.C. § 119 and the Paris Convention Treaty, this application claims foreign priority to Chinese Patent Application No. 201711395396.4 filed Dec. 21, 2017, and to Chinese Patent Application No. 201721809914.8 filed Dec. 21, 2017. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to the field of signal processing technology.

Further, the disclosure relates to a method, system and apparatus for extracting a target unwanted audio signal from a mixture of audio signals.

In the field of signal processing and big data, a major challenge is to increase the signal-to-noise ratio. The most common method is to use a filter either in analogue or digital forms. However, very often the wanted and unwanted signals share the same frequency range and it is impossible for a filter to separate them.

In most cases, the wanted and the unwanted signals originate from different sources that are physically spaced apart. This means that the wanted and unwanted signals take different paths of travel before reaching the observation point. Often, the differences in travelling paths cause consistent patterns in signal attenuation that allows for separation. However, in practice, the differences in signal paths also cause different time delays which decrease the consistency of the attenuation pattern and make the signal separation difficult.

SUMMARY

The disclosure provides a method for removing a target unwanted signal from multiple signals, the method comprising: providing a set of input signals from external devices; separating the input signals into channels with unwanted signal and channels without unwanted signal together with smart phone or any other device with a data exchange interface, CPU and a memory (random percentage of processing) through the data exchange interface; synchronizing the sets of input signals; and transferring separated signal via wire or wirelessly to a sound reproduction device.

Another aspect of the disclosure, a system for removing a target unwanted signal from multiple signal is provided, which comprising a set of input units from external devices for inputting the two or more input signals; a processor; a memory storing computer readable instructions which when executed by the processor, cause the processor to: maximize and maintain the independence of the sets of input signals; extract the coefficients to maximize the independence among the input channels; detect a noise segment or select the preferred direction or select all possible direction; detect the relative position between the microphones and reproduction device, so as to adjust the direction real-time; synchronize the sets of input signals; separate the sets of synchronized input signals into channels with unwanted signal and channels without unwanted signal; and select the optimal channel without unwanted signal as Output signal intelligently.

Still another aspect of the disclosure discloses an apparatus which comprises: two or more microphones, preferred two or more than two microphones; a ADC (analog digital convertor); a memory; a processor; a position detect sensor; a communication module; a data interface module; a physical data exchange interface; a DAC (digital analog convertor); and a wired or wireless sound reproduction device.

According to the disclosure, the apparatus can be used together with a smart phone or any other device with a data exchange interface, CPU and a memory, and the processing can be parallelly run by the smart phone or other device together with external device with any percentage of combination.

DETAILED DESCRIPTION

Hereinafter, the embodiments of the disclosure will be described in detail with reference to the detailed description as well as the drawings.

Figure 1:
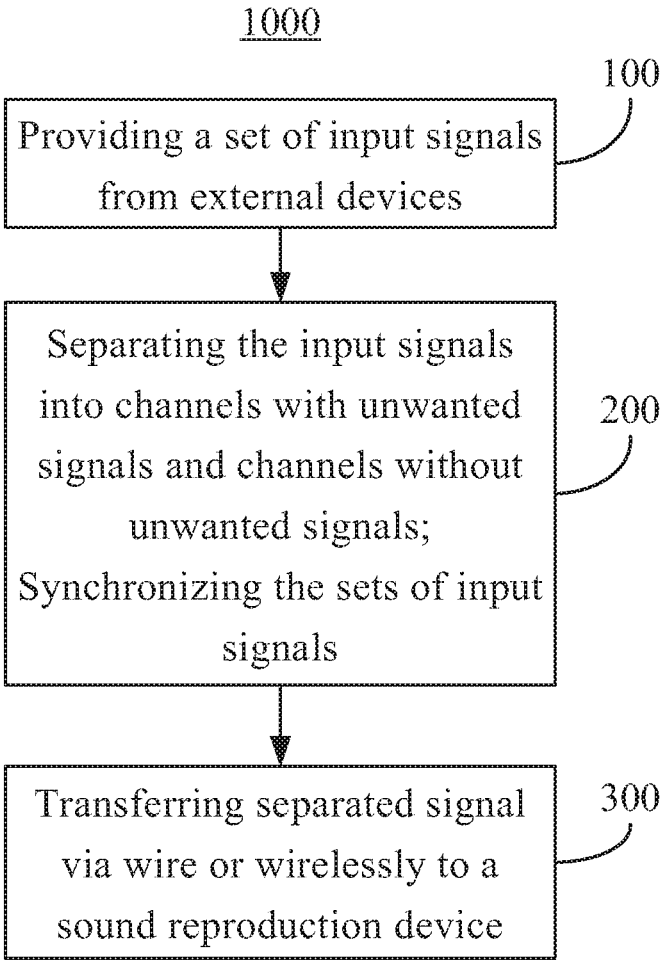
FIG. 1 shows a flow chart of a method for removing a target unwanted signal from multiple signals according to an embodiment of the disclosure.

FIG. 1 shows a flow chart of a method 1000 for removing a target unwanted signal from sets of input signals according to an embodiment of the disclosure.

At operation 100, a set of input signals from the external device are provided. Each of the input signals (observations) comprises the target unwanted signal. In addition, the input signals may comprise unwanted signals that may be different from each other. However, it should be understood that the unwanted signals in the input signals may also be the same, and the disclosure has no limitation in this aspect. For example, in the scenario of an electronic listening device, the electronic listening device typically comprises at least two microphones, each of which may receive a mixture of a signal transmitted from a sound source (wanted signal) and an ambient background sound (unwanted signal). Since the microphones are usually placed at different positions, and thus the signal and the unwanted signal are received at mutually distanced locations, and the ambient background sound received by the microphones may be different in time domain and/or amplitude from each other. For example, in the scenario of sound stage recording and/or 360 audio recording, two or more microphones are used to measure the sound. Since the microphones are usually placed at different positions, and thus the signal and the noise are received at mutually distanced locations, and the ambient background sound received by the microphones may be different in time domain and/or amplitude from each other. Similarly, in the scenario of underwater echo detection, the echo receiving device typically comprises at least two transducers, each of which may receive a mixture of a signal transmitted from a sound source and an ambient noise. Since the transducers are usually placed at different positions, and thus the signal and the noise are received at mutually distanced locations, and the ambient noises received by the transducers may be different in time domain and/or amplitude from each other.

At operation 200, the input signals will be separated into channels with unwanted signal and channels without unwanted signal. This separation process can use both the processor within the external device and the smart phone or other device through the data exchange interface. The process can either entirely be finished by the external device or entirely by finished by the smart phone or random percentage of combination of external device and smart phone. The digital data can be exchanged through the data exchange module between the smart phone and the external device. 200 will be described in details with reference to FIG. 2 as follows.

Figure 2:
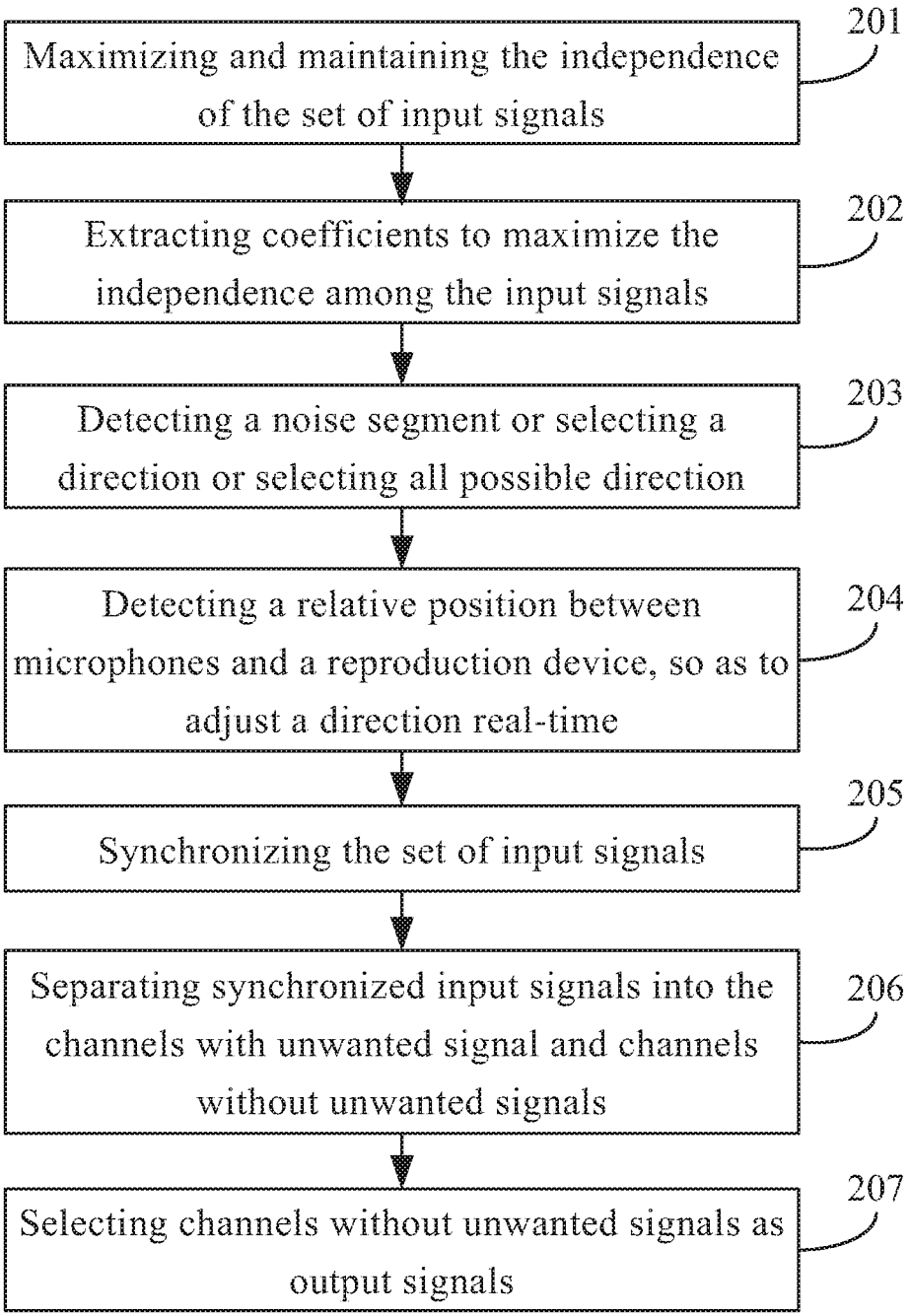
FIG. 2 shows a flow chart of operations of separating separate the input signals into channels with unwanted signal and channels without unwanted signal together with smart phone or any other device with a data exchange interface, CPU and a memory (random percentage of processing) through the data exchange interface.

As shown in FIG. 2, at operation 201, the mathematical formulation of mutual information in both time and frequency domain between the set of input signals is calculated. In the present embodiment, an independent component analysis (ICA) is performed to maximize the independence of the set of input signals. However, those skilled in the art should understand that other appropriate technologies may be used to maximize the independence of the plurality of input signals, and the disclosure has no limitation in this aspect.

At operation 202, the coefficients to maximize the independence is estimated and continuous to be estimated.

At operation 203, it comprises three different ways. The first way is that the segment of unwanted signal is detected. The segment in each of the input signals is detected by performing, for example, pattern recognition. Those skilled in the art should understand that other appropriate technologies may also be employed in this step. As long as one-time segment containing the onset of the noise from a low level to a high level (i.e., a step function) is detected, this will be sufficient for completing the remaining steps. This approach largely reduces the need for complicated noise detection processes and thus reduces the computational complexity and cost; the second way is that the relative direction of unwanted signals can be pre-determined. Since the transducers are usually placed at different positions, and thus the unwanted signal is received at mutually distanced locations. Alternatively, the third way is that all the relative directions can be selected.

At operation 204, it detects the relative position between the microphones and reproduction device, so as to calculate the time-delay real-time.

At operation 205, the set of input signals are synchronized based on the obtained time delay(s) or the calculated time delay(s) from the pre-determined direction of detected noise segment or unwanted signal or a set of time delay(s), $\tau_1$, $\tau_2, \ldots, \tau_n$, from all possible relative direction. For example, if the time delay between the detected unwanted signal segment in a first input signal $f_1(t)$ and the detected unwanted signal segment in a second input signal $f_2(t)$ is determined to be $\delta$, the first input signal $f_1(t)$ is synchronized to be $f_1(t-\delta)$. For another example, if the time delay between the detected unwanted signal segment in the first input signal $f_1(t)$ and the detected unwanted signal segment in the second input signal $f_2(t)$ is determined to be $-\delta$, the first input signal $f_1(t)$ is synchronized to be $f_1(t+\delta)$.

At operation 206, the synchronized input signals are separated into the channels with unwanted signal and channels without unwanted signals with multiplication between matrix of synchronized signals and matrix of coefficients resulted from operation 202.

At operation 207, among the channels with unwanted signal and channels without unwanted signals resulted from operation 206, an intelligent selection process will be applied based on the coefficients resulted from operation 202 or relative volume differences. Moreover, among the channels with unwanted signal, an intelligent selection process will be applied based on feature detection or relative volume differences. One optimal channel will be selected as output signal.

Referring to FIG. 1 again, at operation 300, the processed signal will be transferred through wired or wireless means to sound reproduction device, so as to be audible by users.

Figure 3:
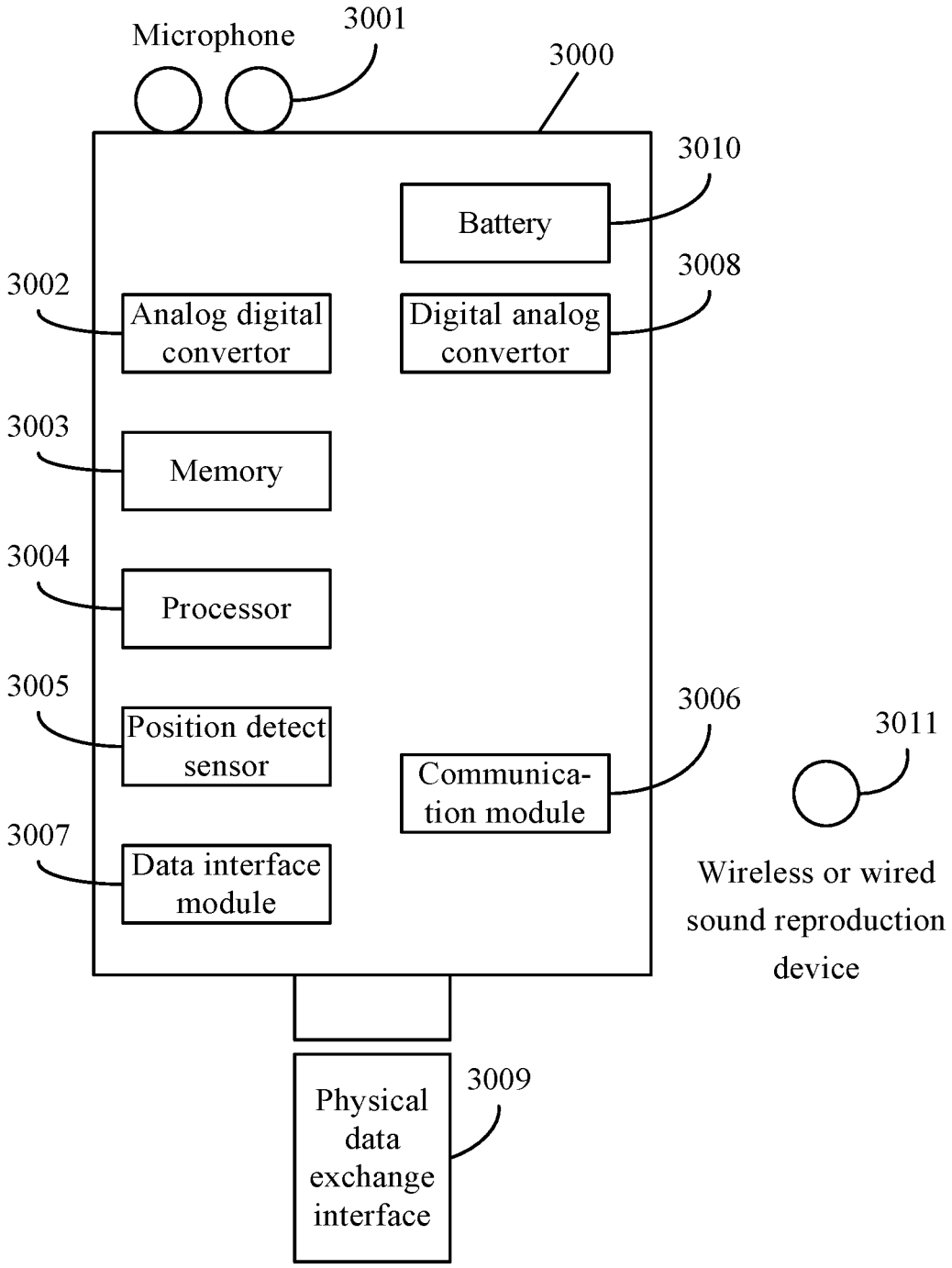
FIG. 3 shows an apparatus of the external device.

Now referring to FIG. 3, an apparatus of the external device 3000 comprises at least two microphones, preferred two microphones in 3001; an analog digital convertor in 3002; a memory in 3003; a processor in 3004; a position detect sensor in 3005; a communication module in 3006; a data interface module in 3007; a digital analog convertor in 3008 which is optional; a physical data exchange interface in 3009, preferred in micro-usb, type-C, lightning, USB etc.; a battery in 3010 which is optional; a wireless or wired sound reproduction device in 3010.

At the component 3001, the number of microphone can be more than two, and preferred be two. If it contains two microphones, the distance between these two microphones can be within the range from 0.1 cm to 100 cm, but preferred within the range from 0.5 cm to 20 cm.

At the component 3002, the ADC is designed to convert the analog signal to digital signal stored in the memory 3003 or directly transferred by data interface module in 3007.

At the component 3003, the memory is optional, if the external device 3000 doesn't have to run any processing, then the memory can be removed. If the external device is designed to run processing, the memory is used to store the executive program and the digital data converted by ADC. The stored program can either be partial or the whole processing of method 1000 in FIG. 1. If the stored program is partial of method 1000 in FIG. 1, the other part will be stored in other device's memory.

At the component 3004, the processor is also optional, if the external device 3000 doesn't have to run any processing, then the processor can be removed. The processor is designed to execute the program. The processor can run either partial or the whole processing of method 1000 in FIG. 1. If partial processing of method 1000 in FIG. 1 will be run by the processor 3004, the rest processing will be executed by other device's processor.

At the component 3005, the position detect sensor is designed to detect the relative position between the microphones 3001 and the sound reproduction device 3011. The position detect sensor can either be Gyro, GPS, PSD or any other sensor could be able to detect the position, or any combination of these sensors. However, those skilled in the art should understand that other appropriate sensors or technologies may be used to detect the relative position between microphones and sound reproduction device, and the disclosure has no limitation in this aspect.

At the component 3006, the communication module is designed to transfer the processed data to wireless or wired sound reproduction device 3011. The communication can be either analog wired or wirelessly through Bluetooth, wifi, NFC, WLAN or any other wireless technologies. The disclosure has no limitation in this aspect.

At the component 3007, the data interface module is designed to transfer digital data through data exchange interface 3009 to the other device.

At the component 3008, the digital analog convertor is designed to convert the digital data to analog data which can be transferred by communication module in wired mode for sound reproduction device 3011.

At the component 3009, the data exchange interface is designed to connect with other device's interface, preferred in the forms of Micro-USB, Type-C, lighting, USB, or any digital interface. And it can provide power to the external device. The disclosure has no limitation in this aspect.

At the component 3010, the battery can be optional. If the external device is powered by 3009, then the battery can be removed. If there is no other power supply, then the battery is needed.

At the component 3010, the wireless or wired sound reproduction device can either be loudspeaker, air-conductive earphone, bone-conductive earphone or any other sound reproduction device. The disclosure has no limitation in this aspect.

Figure 4:
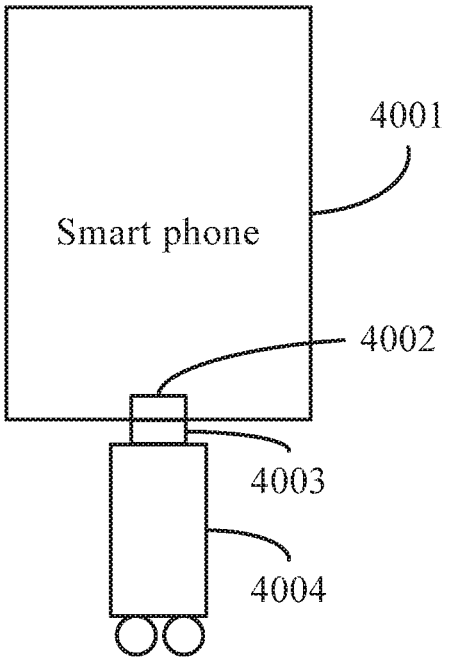
FIG. 4 shows an apparatus of the external device working together with a smart phone.

Now referring to FIG. 4, an apparatus to connect the external device 4004 with a smart phone or other devices 4001 with a data exchange interface, CPU and a memory.

At the component 4001, a smart phone or any other device with a data exchange interface, CPU and a memory. The disclosure has no limitation in this aspect.

At the component 4002, the data exchange interface on the 4001, can be either female plugin or male plugin, preferred in the form of female plugin. And if it is a female plugin, then 4003 has to be male plugin. If it is a male plugin, then 4003 has to be female plugin.

At the component 4003, the data exchange interface on the 4004, can be either female plugin or male plugin, preferred in the form of male plugin. And if it is a female plugin, then 4002 has to be male plugin. If it is a male plugin, then 4002 has to be female plugin.

At the component 4004, the external device is described details in FIG. 3.

It will be obvious to those skilled in the art that changes and modifications may be made, and therefore, the aim in the appended claims is to cover all such changes and modifications.

What is claimed is:

1. A method, comprising:

providing a set of input signals from a signal-input device;

synchronizing the input signals;

processing the synchronized signals to form signals with unwanted signals and signals without the unwanted signals;

transferring the signals without the unwanted signals via wire or wirelessly to a sound reproduction device;

wherein:

processing the synchronized signals to form the signals with the unwanted signals and the signals without the unwanted signals is achieved using a processor within the signal-input device and a smart phone through a data exchange interface; and the combination of synchronizing the input signals and processing the synchronized signals to form the signals with the unwanted signals and the signals without the unwanted signals, comprises:

maximizing and maintaining the independence of the input signals;

extracting coefficients to maximize the independence among the input signals;

detecting a noise segment, selecting a direction, or selecting all possible direction;

synchronizing the input signals;

processing the synchronized signals to form the signals with the unwanted signals and the signals without the unwanted signals; and selecting the signals without the unwanted signals as output signals.

2. The method of claim 1, wherein prior to synchronizing the input signals, the method further comprises detecting relative positions between microphones and the sound reproduction device.

3. A system for removing a target unwanted signal from multiple input signals, the system comprising:

a set of input units from a signal-input device for inputting the input signals;

a processor; and a memory, the memory being adapted to store computer readable instructions, wherein when the instructions are executed by the processor, the processor carries out:

maximizing and maintaining the independence of the input signals;

extracting coefficients to maximize the independence among the input signals;

detecting a noise segment from one direction or all potential directions;

detecting relative positions between microphones and a sound reproduction device;

synchronizing the input signals;

processing the synchronized signals to form signals with the unwanted signal and signals without the unwanted signal; and selecting an optimal signal without the unwanted signal as an output signal.

4. A device for removing a target unwanted signal from multiple input signals, the device comprising: microphones being adapted to receive the input signals; an analog digital convertor (ADC); a memory; a processor; a communication module; a data interface module; a physical data exchange interface; and a sound reproduction device; wherein:

the memory is adapted to store computer readable instructions, wherein when the instructions are executed by the processor, the processor carries out:

maximizing and maintaining the independence of the input signals;

extracting coefficients to maximize the independence among the input signals;

detecting a noise segment from one direction or all potential directions;

detecting relative positions between the microphones and the sound reproduction device;

synchronizing the input signals;

processing the synchronized signals to form signals with the unwanted signal and signals without the unwanted signal; and selecting an optimal signal without the unwanted signal as an output signal.

5. The device of claim 4, wherein the device further comprises a position detect sensor, and the position detect sensor is designed to detect the relative positions between the microphones and the sound reproduction device.

6. The device of claim 5, wherein the position detect sensor is a gyro, a global positioning system (GPS), or a phase sensitive detector (PSD).

7. The device of claim 4, wherein the device further comprises a digital analog convertor (DAC).

8. The device of claim 4, wherein the sound reproduction device is a loudspeaker, air-conductive earphone, or bone-conductive earphone.

* * * * *